US010167000B2

(12) United States Patent
Popadiuc et al.

(10) Patent No.: US 10,167,000 B2
(45) Date of Patent: Jan. 1, 2019

(54) FUEL SUPPLY SYSTEM FOR A LOCOMOTIVE

(71) Applicant: Progress Rail Locomotive Inc., LaGrange, IL (US)

(72) Inventors: Ovidiu Petru Popadiuc, Bensenville, IL (US); Daniel W. Schmidt, McCordsville, IN (US)

(73) Assignee: Progress Rail Lovomotive Inc., LaGrange, IL (US)

( * ) Notice: Subject to any disclaimer, the term of this patent is extended or adjusted under 35 U.S.C. 154(b) by 488 days.

(21) Appl. No.: 14/814,554

(22) Filed: Jul. 31, 2015

(65) Prior Publication Data

US 2017/0028997 A1 Feb. 2, 2017

(51) Int. Cl.

| | |
|---|---|
| ***B61C 17/02*** | (2006.01) |
| ***B61D 5/06*** | (2006.01) |
| ***B61C 5/00*** | (2006.01) |

(52) U.S. Cl.

CPC ..... *B61C 17/02* (2013.01); *B61C 5/00* (2013.01); *B61D 5/06* (2013.01)

(58) Field of Classification Search

CPC .. B61C 17/02; B61C 5/00; B61D 5/02; B61D 5/06

See application file for complete search history.

(56) References Cited

U.S. PATENT DOCUMENTS

| | | | | | |
|---|---|---|---|---|---|
| 3,857,245 | A * | 12/1974 | Jones | F25J 1/0025 | 60/651 |
| 4,924,822 | A * | 5/1990 | Asai | F02M 21/00 | 123/27 GE |
| 5,375,580 | A * | 12/1994 | Stolz | F02B 29/0443 | 123/527 |
| 5,887,567 | A * | 3/1999 | White | B61C 5/00 | 123/294 |
| 7,690,365 | B2 * | 4/2010 | Lee | B63B 25/14 | 123/27 GE |
| 7,841,322 | B2 * | 11/2010 | Bach | F02B 29/0418 | 123/543 |
| 7,996,147 | B2 * | 8/2011 | Gokhale | F02D 35/023 | 60/602 |
| 8,522,691 | B1 * | 9/2013 | Foege | F01P 11/14 | 105/26.05 |
| 2006/0213488 | A1 * | 9/2006 | Post | F02M 55/005 | 123/527 |
| 2010/0175579 | A1 * | 7/2010 | Read | B60T 1/10 | 105/1.4 |

(Continued)

FOREIGN PATENT DOCUMENTS

| | | |
|---|---|---|
| CN | 104154415 | 11/2014 |
| EP | 2154044 | 1/2012 |

*Primary Examiner* — Jason C Smith

(57) ABSTRACT

A fuel supply system for mounting to an undercarriage of a locomotive includes a first enclosure and a second enclosure that are disposed below the undercarriage of the locomotive. The first enclosure is configured to extend partway along a length of the undercarriage and is designated to store a first type of fuel therein. The second enclosure is located adjacent to the first enclosure and configured to extend parallelly with respect to the undercarriage. The second enclosure is designated for enclosing components that are configured for supplying a second type of fuel to an engine of the locomotive.

9 Claims, 3 Drawing Sheets

(56) References Cited

U.S. PATENT DOCUMENTS

2013/0213256 A1* 8/2013 McAlister ..... B01J 12/007
105/62.1
2014/0033943 A1* 2/2014 Foege ..... B61C 5/00
105/1.4
2014/0123916 A1* 5/2014 Coldren ..... F02B 43/10
123/3
2014/0216403 A1* 8/2014 Stockner ..... F02M 69/08
123/445
2014/0290279 A1* 10/2014 Lee ..... B63B 25/16
62/48.2
2015/0075488 A1* 3/2015 Touchette ..... F02D 19/0605
123/299
2015/0128597 A1* 5/2015 Schlak ..... F03B 13/00
60/719
2015/0345430 A1* 12/2015 Foege ..... F02M 21/0215
105/61.5
2016/0017845 A1* 1/2016 Huang ..... F02M 21/0209
290/1 A
2016/0102617 A1* 4/2016 Coldren ..... F02D 41/3017
105/62.1
2016/0273491 A1* 9/2016 Foege ..... F02M 21/0224
2017/0028997 A1* 2/2017 Popadiuc ..... B61C 17/02
2017/0145961 A1* 5/2017 Myers ..... F02M 21/0296

* cited by examiner

FUEL SUPPLY SYSTEM FOR A LOCOMOTIVE

TECHNICAL FIELD

The present disclosure relates to a fuel supply system for a locomotive. More particularly, the present disclosure relates to a fuel supply system for mounting to an undercarriage of a locomotive.

BACKGROUND

Engines of locomotives may sometimes require two or more types of fuel for powering various motors and equipment associated with the locomotive. Such cases may occur for e.g., when an engine associated with a locomotive is of a type that uses one fuel as a pilot fuel and the other fuel as a main fuel. In such cases, manufacturers of locomotives may typically employ numerous systems for supplying the different types of fuels to the engine of the locomotive.

For reference, U.S. Publication 2014/0033943 discloses a fuel distribution system for a consist of a locomotive. The fuel distribution system may have a first locomotive, a second locomotive, and a tender car. The fuel distribution system may also have at least one pump located onboard the tender car, and at least one fluid conduit attached to the at least one pump. The at least one fluid conduit may be configured to deliver gaseous fuel from the tender car to the first and second locomotives.

However, manufacturers of locomotives are also developing newer ways of supplying distinct types of fuel to the engines of locomotives when situations require that such distinct types of fuel be delivered.

SUMMARY OF THE DISCLOSURE

In one aspect of the present disclosure, a fuel supply system for mounting to an undercarriage of a locomotive includes a first enclosure and a second enclosure that are disposed below the undercarriage of the locomotive. The first enclosure is configured to extend partway along a length of the undercarriage and is designated to store a first type of fuel therein. The second enclosure is located adjacent to the first enclosure and configured to extend parallelly with respect to the undercarriage. The second enclosure is designated for enclosing components that are configured for supplying a second type of fuel to an engine of the locomotive.

In another aspect of the present disclosure, a locomotive includes an undercarriage; an engine rigidly supported on the undercarriage; and a fuel supply system for supplying fuel to the engine. The fuel supply system includes a first enclosure and a second enclosure that are disposed below the undercarriage of the locomotive. The first enclosure is configured to extend partway along a length of the undercarriage and is designated to store a first type of fuel therein. The second enclosure is located adjacent to the first enclosure and configured to extend parallelly with respect to the undercarriage. The second enclosure is designated for enclosing components that are configured for supplying a second type of fuel to the engine of the locomotive.

In another aspect of the present disclosure, the components for supplying the second type of fuel to the engine are adapted to supply the second type of fuel at injection pressures of approximately 100 bar to 850 bar to the engine of the locomotive.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
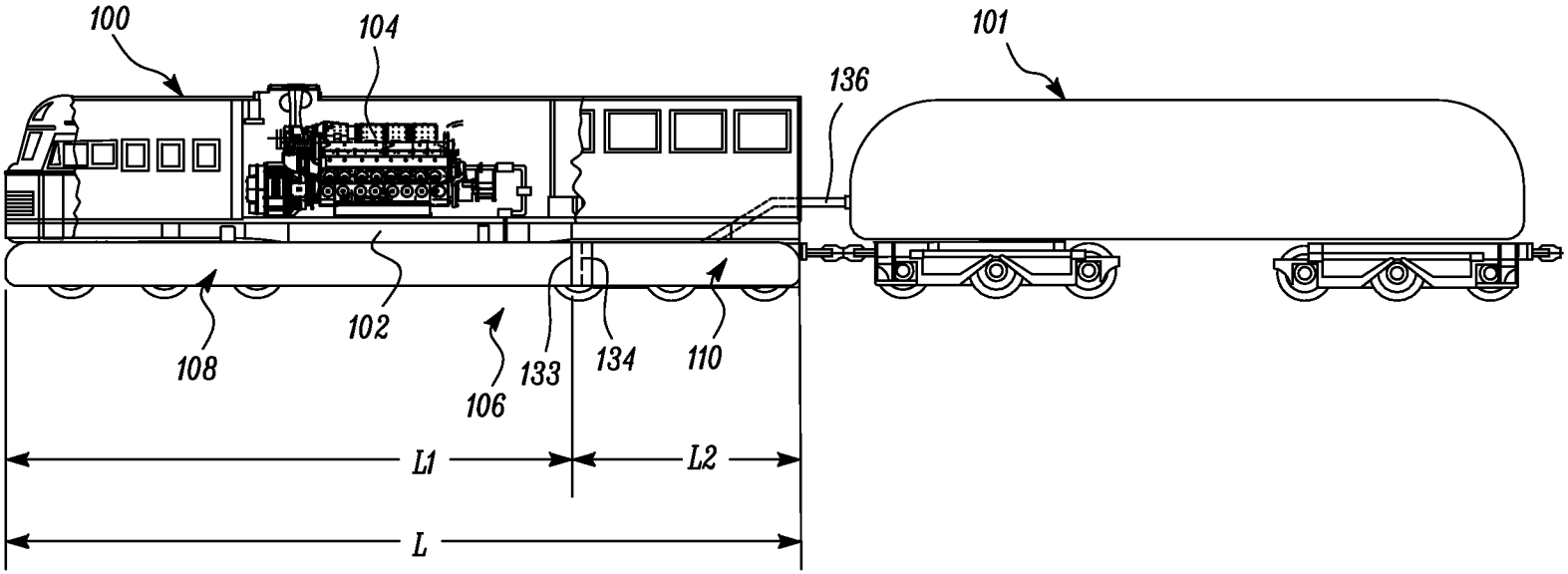
FIG. 1 is a side elevation of a locomotive and a fuel tender, in accordance with embodiments of the present disclosure.

FIG. 1 illustrates a side elevation of a locomotive 100 and a fuel tender 101, in accordance with embodiments of the present disclosure. The locomotive 100 may be used to hoist a consist (not shown) in a variety of applications including, but not limited to, transportation of passengers, transportation of material, shunting of railcars, and the like. As shown in FIG. 1, the fuel tender 101 is located adjacent to the locomotive 100. The fuel tender 101 is configured to store a supply of fuel therein, detailed explanation to which will be made later in this document.

The locomotive 100 includes an undercarriage 102; an engine 104 rigidly supported on the undercarriage 102; and a fuel supply system 106 for supplying fuel to the engine 104. The engine 104 disclosed herein may be, for e.g., but not limited to, a natural gas engine employing diesel as a pilot fuel.

Figure 2:
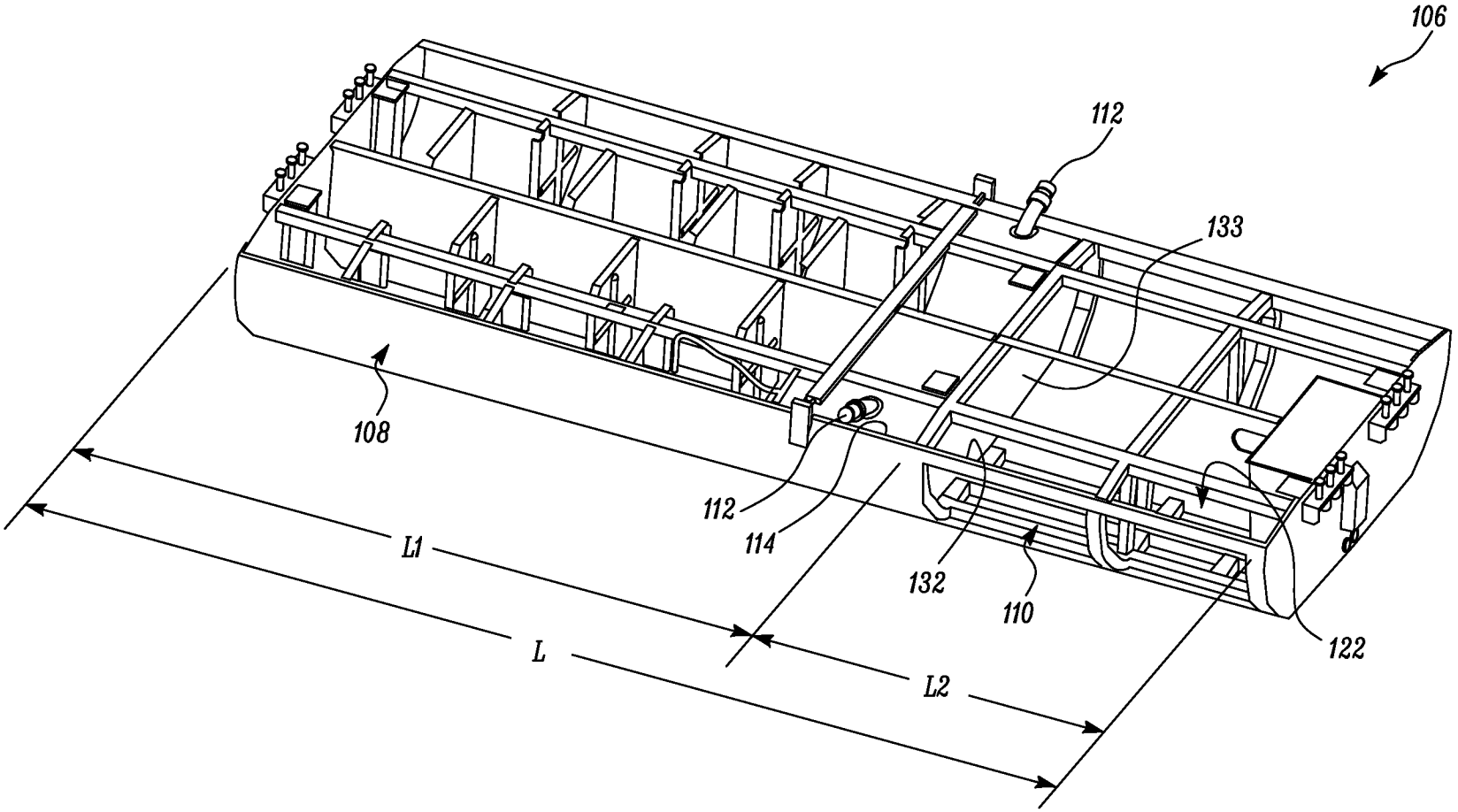
FIG. 2 is a top perspective view of a fuel supply system employed by the locomotive of FIG. 1, in accordance with embodiments of the present disclosure.
Figure 3:
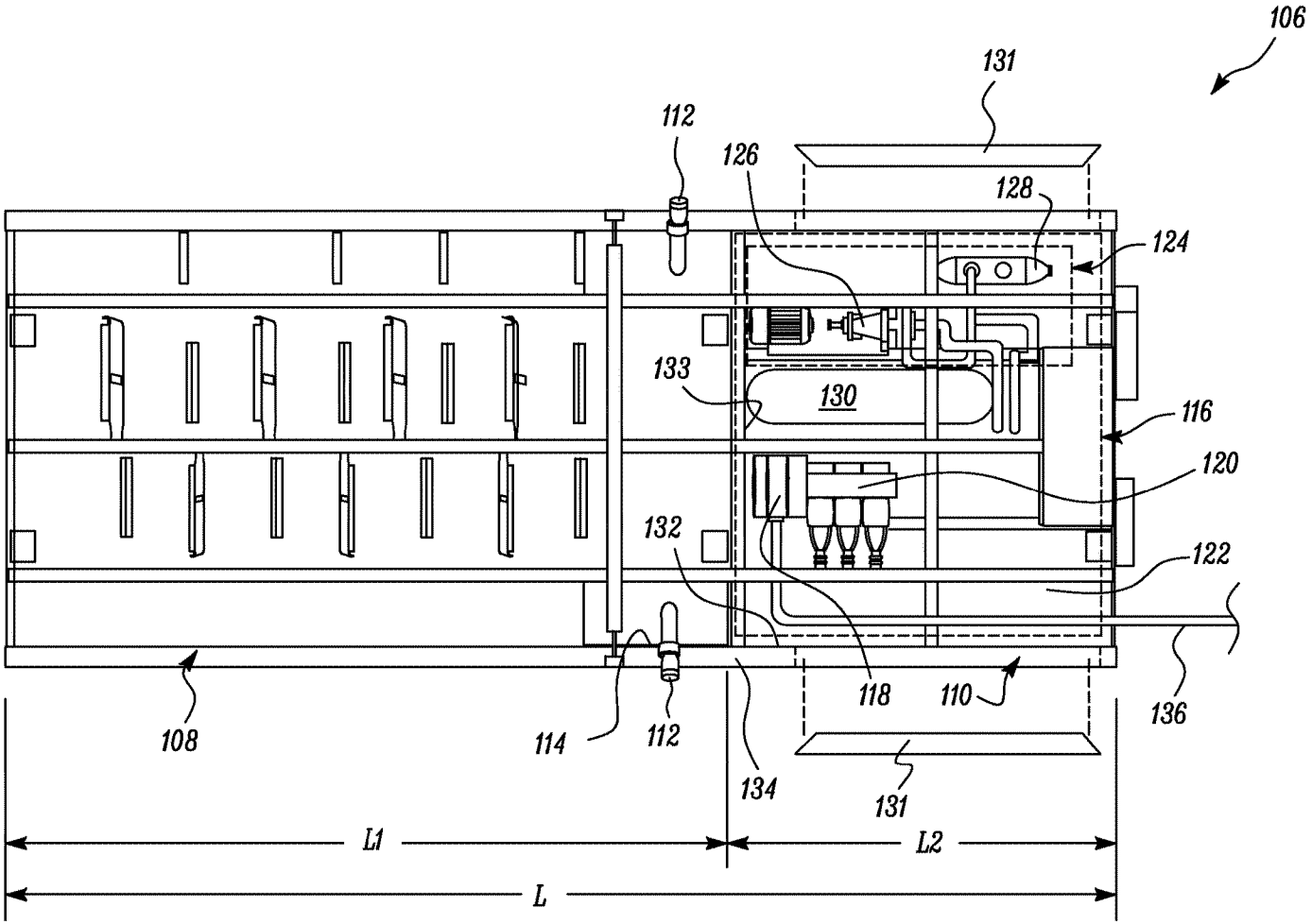
FIG. 3 is a top view of the fuel supply system showing components that are configured for supplying a second type of fuel to an engine of the locomotive, in accordance with embodiments of the present disclosure.

As best shown in FIGS. 2-3, the fuel supply system 106 includes a first enclosure 108 and a second enclosure 110 that are disposed below the undercarriage 102 of the locomotive 100 (see FIG. 1). Referring to FIGS. 1-3, the first enclosure 108 is configured to extend partway along a length L of the undercarriage 102 (See 'L1'—length of first enclosure, and 'L'—length of undercarriage 102 in FIG. 1, wherein L1<L). The first enclosure 108 is designated to store a first type of fuel therein. In an embodiment, the first enclosure 108 may be configured to store Diesel therein.

Moreover, as shown in FIGS. 2-3, the first enclosure 108 includes an inlet port 112 angled away from a sidewall 114 of the first enclosure 108. The inlet port 112 allows for filling of the first enclosure 108 with the first type of fuel. In the illustrated in the embodiment of FIGS. 2-3, two inlet ports 112 are shown provided on a pair of opposing sidewalls 114 of the first enclosure 108. However, it may be noted that any number of inlet ports 112 may be provided to the first enclosure 108 for the filling of the first type of fuel within the first enclosure 108 depending on specific requirements of an application.

Moreover, in various embodiments of the present disclosure, the fuel tender 101 is configured to store a second type of fuel therein. The second type of fuel, disclosed herein, may be Liquefied Natural Gas (LNG). Although it is disclosed herein that the first enclosure 108 and the fuel tender 101 are configured to respectively store Diesel and LNG, one of ordinary skill in the art may contemplate using other types of fuels in place of Diesel and LNG respectively.

With continued reference to FIGS. 1-3, the second enclosure 110 is located adjacent to the first enclosure 108 and is configured to extend parallelly with respect to the undercarriage 102 (See 'L2'—length of second enclosure in FIG. 2). The second enclosure 110 is designated for enclosing components 116 that are configured for supplying the second type of fuel from the fuel tender 101 to the engine 104 of the locomotive 100.

In various embodiments of the present disclosure, it may be noted that the components 116 for supplying the second type of fuel are beneficially adapted to supply the second type of fuel at relatively high injection pressures. These injection pressures, measured at an inlet (not shown) of the engine 104 may lie in the range of 100 bar to 850 bar. In a preferred embodiment, the components 116 disclosed herein may be more specifically configured to deliver the second type of fuel to the engine 104 at injection pressures of about 400 to 850 bar. For example, in one application, the components 116 may be configured to deliver the second type of fuel at an injection pressure of 200 bar. In another application, the components 116 may be configured to deliver the second type of fuel at an injection pressure of 400 bar. In yet another application, the components 116 may be configured to deliver the second type of fuel at an injection pressure of 650 bar. Therefore, notwithstanding anything contained in this document, it should be noted that the components 116 disclosed herein can be configured to suit the operational requirements of the engine 104 as well as other specific requirements associated with the application. Further explanation pertaining to the components 116 will be made hereinafter.

As shown in the illustrated embodiment of FIG. 3, the components 116 for supplying the second type of fuel may include an electric motor 118, and a first pump 120 coupled to the electric motor 118. The first pump 120 can receive the second type of fuel from the fuel tender 101, and pressurize the second type of fuel for supplying to the engine 104. As shown in the embodiments of FIGS. 2-3, the second enclosure 110 further defines an opening 122 that allows a supply line 136 from the fuel tender 101 to fluidly couple with the first pump 120.

As shown in FIG. 3, the fuel supply system 106 additionally includes a vaporizer system 124 that is disposed downstream of the first pump 120 and configured to vaporize the second type of fuel before being supplied to the engine 104. In the illustrated embodiment of FIG. 3, the vaporizer system 124 includes a second pump 126, and a heater 128 that is disposed downstream of the second pump 126. The second pump 126 is configured to supply a pressurized vaporizing fluid for e.g., glycol to the heater 128. The heater 128 is configured to receive the pressurized vaporizing fluid and increase a temperature of the second type of fuel. In various embodiments disclosed herein, it may be noted that the first pump 120 and the vaporizer system 124 (i.e., the second pump 126 and the heater 128) together help in vaporizing the LNG into Compressed Natural Gas (CNG).

Moreover, as shown in the embodiment of FIG. 3, the components 116 for supplying the second type of fuel may further include an accumulator 130 that is preferably located between the vaporizer system 124 and the engine 104. The accumulator 130 can beneficially store a pre-defined vaporized volume of the second type of fuel (i.e., now converted CNG) that is received from the first pump 120.

As shown in FIG. 3, the second enclosure 110 further includes at least one access door 131 that is configured to allow access to the components 116 for supplying the second type of fuel. Two access doors 131 are shown coupled to the sidewalls 132 of the second enclosure 110 in the illustrated embodiments of FIG. 3. However, any number of access doors 131 may be provided, and suitably sized and/or shaped to allow service personnel to access the components 116 present within the second enclosure 110.

Moreover, these access doors 131 may be releasably secured to the respective sidewalls 132 of the second enclosure 110 by way of hinges, latches, screws, bolts, nuts, and other mechanisms commonly to known to one skilled in the art. A manner of securing the access doors 131 to the sidewalls 132 of the second enclosure 110 is exemplary in nature and hence, non-limiting of this disclosure. Any type of securing mechanism can be used to implement the releasable connection of the access doors 131 to the second enclosure 110.

Further, in an embodiment as shown in FIGS. 1-3, the fuel supply system 106 further includes a separator mid-wall 133 that is disposed at an intersection 134 of the first and second enclosures 108, 110. The separator mid-wall 133 may be configured to hermetically seal the first and second enclosures 108, 110 and hence, prevent an intermixing of the first and second types of fuels from the first and second enclosures 108, 110 respectively. The separator mid-wall 133 may be designed to hermetically seal the first enclosure 108 from the second enclosure 110 and vice-versa. For example, the separator mid-wall 133 may be configured with air-tight linings (not shown) to accomplish the hermetic sealing of the first and second enclosures 108, 110 with respect to one another. Therefore, notwithstanding any particular type, material, or configuration of the mid-wall 133 disclosed in this document, it will be appreciated that any type, material, or configuration of the mid-wall 133 can be used to hermetically seal the first enclosure 108 with respect to the second enclosure 110 without deviating from the spirit of the present disclosure.

Various embodiments disclosed herein are to be taken in the illustrative and explanatory sense, and should in no way be construed as limiting of the present disclosure. All joinder references (e.g., attached, affixed, coupled, engaged, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in supplying fuel to engines of locomotives that typically employ more than one type of fuel for its operation. In recent times, manufacturers of locomotives have been opting to use alternate fuels to reduce costs associated with use of expensive fuels. Accordingly, manufacturers are employing engines that can run on more than one type of fuel. However, when installing systems for supplying two or more types of fuel, manufacturers may face various challenges such as, but not limited to, bulky system design, tight space constraints, and other limitations associated with use of distinct fuels.

However, with use of embodiments disclosed herein, manufacturers can conveniently accomplish the delivery of at least two distinct types of fuels, for e.g., Diesel and CNG to the engine 104 of the locomotive 100. Moreover, the fuel supply system 106 disclosed herein is simple in construction and of a compact size and configuration, thereby allowing manufacturers to easily retro-fit/install the fuel supply system 106 of the present disclosure onto existing locomotives with or without removal of the previously used fuel systems. Moreover, as the components 116 for supplying the second type of fuel are packaged to fit in a compact manner within the second enclosure 110, the second enclosure 110 can also be configured to provide easy access by way of the access doors 131. Therefore, service personnel can easily perform various service routines and overhaul of the components 116 present within the second enclosure 110.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A locomotive comprising:

an undercarriage;

an engine rigidly supported on the undercarriage; and a fuel supply system for supplying fuel to the engine, the fuel supply system comprising:

a first enclosure disposed on an underside of the undercarriage and configured to extend partway along a length of the undercarriage, the first enclosure designated to store a first type of fuel therein; and a second enclosure located adjacent to the first enclosure and configured to extend parallelly with respect to the undercarriage, the second enclosure designated for enclosing components configured for supplying a second type of fuel to the engine of the locomotive, wherein the components for supplying the second type of fuel include at least:

an electric motor;

a first pump coupled to the electric motor, the first pump configured to:

receive the second type of fuel from a fuel tender located adjacent to the locomotive; and pressurize the second type of fuel for supplying to the engine; and at least one vaporizer system disposed downstream of the first pump for vaporizing the second type of fuel before being supplied to the engine.

2. The locomotive of claim 1, wherein the components for supplying the second type of fuel include at least:

an accumulator disposed between the vaporizer system and the engine, the accumulator configured to store a pre-defined vaporized volume of the second type of fuel.

3. The locomotive of claim 1, wherein the vaporizer system includes at least:

a second pump configured to supply a pressurized vaporizing fluid; and a heater disposed downstream of the second pump, the heater configured to receive the pressurized vaporizing fluid and increase a temperature of the second type of fuel.

4. The locomotive of claim 1, wherein the second enclosure defines an opening therein, the opening configured to allow a supply line from the tender for fluidly coupling with the first pump.

5. The locomotive of claim 1, wherein the second enclosure further includes at least one access door configured to allow access to the components for supplying the second type of fuel.

6. The locomotive of claim 1, wherein the fuel supply system further comprises a separator mid-wall disposed at an intersection of the first and second enclosures, the separator mid-wall being configured to hermetically seal the first and second enclosures.

7. The locomotive of claim 1, wherein the first enclosure further comprises an inlet port angled away from a sidewall of the first enclosure.

8. The locomotive of claim 1, wherein the components for supplying the second type of fuel to the engine are adapted to supply the second type of fuel at injection pressures of approximately 100 bar to 850 bar to the engine of the locomotive.

9. The locomotive of claim 1, wherein the components for supplying the second type of fuel to the engine are adapted to supply the second type of fuel at injection pressures of approximately 400 bar to 850 bar to the engine of the locomotive.

* * * * *